US005878817A

United States Patent [19]

Stastka

[11] Patent Number: 5,878,817

[45] Date of Patent: Mar. 9, 1999

[54] APPARATUS AND PROCESS FOR CLOSED LOOP CONTROL OF WELL PLUNGER SYSTEMS

[75] Inventor: Stephen L. Stastka, Woodward, Okla.

[73] Assignee: Amoco Corporation, Chicago, Ill.

[21] Appl. No.: 667,081

[22] Filed: Jun. 20, 1996

[51] Int. Cl.[6] ..... E21B 34/16; E21B 43/12

[52] U.S. Cl. ..... 166/372; 166/53

[58] Field of Search ..... 166/53, 370, 369, 166/372; 137/624.15, 624.2

[56] References Cited

U.S. PATENT DOCUMENTS

| | | | |
|---|---|---|---|
| 3,863,714 | 2/1975 | Watson, Jr. | 166/53 |
| 4,275,790 | 6/1981 | Abercrombie | 166/53 |
| 4,596,516 | 6/1986 | Scott et al. | 417/58 |
| 4,664,602 | 5/1987 | Gordon | 417/56 |
| 4,685,522 | 8/1987 | Dixon et al. | 166/372 |
| 4,921,048 | 5/1990 | Crow et al. | 166/372 |
| 4,923,372 | 5/1990 | Ferguson et al. | 417/53 |
| 4,989,671 | 2/1991 | Lamp | 166/53 |
| 5,132,904 | 7/1992 | Lamp | 166/53 X |
| 5,146,991 | 9/1992 | Rogers, Jr. | 166/369 |
| 5,253,713 | 10/1993 | Gregg et al. | 166/372 |
| 5,636,693 | 6/1997 | Elmer | 166/370 |

OTHER PUBLICATIONS

"What's New in Artificial Lift", James F. Lea and Herald W. Winkler, World Oil/Apr. 1994 pp. 107–114.

"Plunger–Lift Performance Criteria With Operating Experience—Ventura Avenue Field" D. L. Foss and R. B. Gaul, Shell Oil Company, Presented at the Spring Meeting, May, 1965 pp. 125–140.

*Primary Examiner*—Hoang C. Dang

*Attorney, Agent, or Firm*—Arnold White & Durkee

[57] ABSTRACT

A well plunger system for the production of natural gas is described. The well plunger system includes a closed loop controller for the production of natural gas. The well plunger system includes a plunger tube positioned within a casing of a gas well, a tubing line connected to the plunger tube, a plunger moveable within the plunger tube, a plunger sensor for detecting the presence of the plunger, a valve connected to the tubing line and to the general gas distribution system including a sales line and a gas flow meter, a differential pressure sensor positioned in the sales line, a motor for operating the valve, a first pressure sensor positioned in the tubing line and a second pressure sensor positioned in the sales line. The controller opens the valve based on an open pressure difference which is the difference between the pressure of gas in the tubing line and the pressure of gas in the sales line. The controller adjusts the open pressure difference used for each cycle of operation based on the calculated speed of the plunger during the previous cycle of operation versus a target speed. During gas production, the controller maintains the differential pressure of the gas in the sales line within a high differential pressure range, until the pressure in the gas is insufficient. The controller closed the valve when the differential pressure of the gas in the sales line falls below a low differential pressure limit. The low differential pressure limit is adjusted by the controller to prevent excessive plunger speeds.

15 Claims, 8 Drawing Sheets

APPARATUS AND PROCESS FOR CLOSED LOOP CONTROL OF WELL PLUNGER SYSTEMS

FIELD OF THE INVENTION

This invention relates generally to an apparatus and process for the control of well plunger systems, more specifically, the closed loop control of well plunger lifts in natural gas and oil wells.

BACKGROUND OF THE INVENTION

In a well plunger system of a type utilizing the present invention, the primary focus is on the production of natural gas ("gas"), but the invention is also applicable to well plunger systems where the primary focus is on oil production. Accordingly, the invention is described in association with a well plunger system producing natural gas but the scope of the invention is not limited to such a system. To begin gas production, a well is bored into the earth to facilitate the removal of gas. In many gas wells the relatively low rate of gas flowing into the well is insufficient to expel oil and water that leak into the well. This unwanted oil and water must be removed from the well, otherwise gas production will effectively cease. Plunger systems powered by the force of the gas pressure itself have been used in an attempt to address this problem.

In a typical well plunger system, the well is sealed off from the outside world with a valve and a cylindrical casing in the well. A sales line connects the valve to the remainder of the gas distribution system and a sales meter is connected to the sales line for measuring amount of gas that has passed through the sales line. An opening at the bottom of the casing permits gas to enter the interior of the casing. Closing the valve has the effect of allowing pressure inside the casing to increase. A tube extends from the valve to near the bottom of the casing. A plunger is positioned at or near the bottom of the tube. After a fixed amount of time has past, or after the casing pressure has exceeded a particular threshold value, the valve is automatically opened and the plunger is forced upward due to the built up pressure inside the casing. Ideally, opening of the valve in this manner allows the gas, as well as any oil and water, to be forced up the plunger tube inside the casing by the plunger. As long as the valve is open, more gas, and in many instances oil and water, flow into the plunger tubing below the plunger. Once the plunger reaches the top of the plunger tube, gas flows through or past the plunger into a line. After a fixed amount of time has past, or after the casing pressure has fallen below a particular threshold value, the valve is closed and the plunger returns back down the tubing to a rest position at or near the bottom of the tube.

In known well plunger systems a controller senses the gas pressure in the casing and opens the valve when the pressure exceeds a fixed value or a fixed amount of time has past. These known well plunger systems have a number of problems in the production of natural gas. If a controller blindly opens the valve when the casing pressure is deemed sufficient, or after a fixed amount of time has past since the last cycle, the valve may either be opened too early or too late in the cycle to optimize gas production. If the valve is opened too early, the pressure in the casing is insufficient to force the plunger to completely lift the water and oil out of the well. If this continues it can result in the well becoming filled ("logged") with oil and water and shutting down ("logging off"). In this case, gas production continues to decrease until it ceases, causing an interruption in gas production and a corresponding loss of revenues derived from that well. It is desirable to prevent the logging off of wells.

In the situation where the valve is opened too late, excessive pressures can build up behind the plunger, forcefully impacting the plunger against the top of the casing and potentially causing damage. Even if no damage is done, waiting too long between opening the valve after each cycle means less gas is produced from the well, again resulting in a corresponding loss of revenues derived from that well. In addition, when excessive pressure builds in the casing, the corresponding pressure differential between the tubing line pressure and the sales line pressure becomes great. In this situation when the valve is opened and the plunger rises at high speeds, the gas flow in the sales line exceeds the maximum measurable by the sales meter. Of course, there is a corresponding loss of revenues derived from the well when quantities of gas flow from the well into the sales line without being registered on the sales meter. Accordingly, it is desirable to optimize the amount of time that is allowed to pass between intervals of opening the valve.

Another problem with known well plunger systems is their inability to modify operation to compensate for the variability of the well's ability to produce natural gas over long periods of time or changes in the sales line pressure. Thus, the characteristics of even a once perfectly tuned system change over great lengths of time, causing the interval between opening the valve to be less than optimal. Accordingly, it is desirable to control a well plunger system in a manner that compensates for changing characteristics of the well such as variability in the well's ability to produce natural gas and variations in sales line pressure.

Yet another problem with known well plunger systems is their inability to adjust the gas flow rate in view of excessive tubing line pressure. Even after the initial rush of gas past the sales meter without detection due to a high build up of pressure in the tubing line causing an excessive pressure differential between the tubing line pressure and the sales line pressure, if the tubing line pressure is very high the gas flow rate past the sales meter exceeds the maximum measurable by the meter. Again this situation results in a loss of revenue from the well. Accordingly, it is desirable to have a well plunger system that adjusts the gas flow rate to compensate for high tubing line pressure.

SUMMARY OF THE INVENTION

The problems described above are overcome by the well plunger system of the present invention which has a closed loop controller for optimizing production by controlling when the well is opened and closed. In the preferred embodiment, the well plunger system comprises a plunger tube positioned within the casing of a gas well, a tubing line connected to the plunger tube, a plunger moveable within the plunger tube, a plunger sensor for detecting the presence of the plunger, a valve connected to the tubing line and to the general gas distribution system including a sales line and a gas flow meter, a differential pressure sensor positioned in the sales line, a controller for operating the valve through a motor, a first pressure sensor positioned in the tubing line and a second pressure sensor positioned in the sales line. The well plunger system is described for use with a well whose primary purpose is the production of gas. However, it is within the scope of the present invention for the well plunger system to also be used in wells whose primary purpose is the production of oil. The controller is connected to the first pressure sensor which transmits electrical signals indicative of the pressure of gas in the tubing line, before the gas reaches the valve, and the second pressure sensor which transmits electrical signals indicative of the pressure of gas in the sales line, after the gas passes the valve.

The controller opens the valve when two conditions exist, specifically when a minimum amount of time has past since the valve was last closed and the difference between the pressure of gas in the tubing line and the pressure of gas in the sales line exceeds a predetermined value known as the "open pressure difference". The controller determines the amount of lapsed time from the last closure of the valve and compares the lapsed time to a preselected time. When the lapsed time exceeds the preselected time the first condition for opening the valve is met. This preselected time is selected to be the minimum amount of time needed for the plunger to drop to a stop at the bottom of the plunger tube after the valve is closed. Now, the controller determines if the difference between the tubing line pressure and the sales line pressure exceeds the open pressure difference, if so the second condition also exists and the valve is opened. Opening the valve based upon the combination of a minimum time and the open pressure difference makes the well plunger system much less sensitive to changes in sales line pressure. The controller modifies the open pressure difference used for each cycle of operation based on the calculated speed of the plunger during the previous cycle of operation. The speed of the plunger is calculated based on the amount of time it takes the plunger to travel from the bottom of the plunger tubing when the valve is open to when the plunger is detected by the plunger sensor at the top of the plunger tubing.

Once the minimum amount of time has passed and open pressure difference is exceeded, the controller opens the valve to the maximum extent possible. The controller maintains the actual differential pressure ("DP") approximately at a high DP setpoint which is half way between a high DP limit and a high DP minimum. The controller now monitors the actual differential pressure ("DP") from the differential pressure sensor attached to the sales line and compares it to both a variable low DP limit and a fixed high DP setpoint. The high DP limit is fixed at a value slightly less than the maximum amount of differential pressure the sales meter attached to the sales line can receive and still accurately record the amount of gas flowing in the sales line. The low DP limit is set at a point where the well will begin to fill with oil or water because the low flowrate permits the accumulation of fluids in the well while it is producing gas. In the situation where the actual DP reported by the differential pressure sensor is above the high DP limit, the controller incrementally begins closing the valve until the DP drops to a high DP setpoint, which is slightly below the high DP limit. This prevents more gas than can be accounted for flowing past the sales meter and solves the free gas problem mentioned above. The controller keeps the actual DP approximately at the high DP setpoint by keeping the actual DP between the high DP limit and the high DP minimum, thereby maximizing gas production. Eventually the gas pressure produced by the well begins to drop as gas is drained out of the well and it begins to be filled with fluids. To counteract the drop in actual DP below a high DP minimum, the controller begins to incrementally open the valve until the DP is restored to the high DP setpoint or the valve is completely open. At some point when the valve is completely open, the actual DP drops below the high DP minimum but is above the low DP limit, in this situation the system continues its operation.

After the valve is completely open and the plunger has either arrived or failed to arrive within a set amount of time, if the actual DP reported by the differential pressure sensor drops below the low DP limit for a specified amount of time the controller causes the valve to close and the cycle begins again. The low DP limit is adjusted within a permissible range by the controller based on plunger performance.

In the situation when the valve is initially open and the actual DP from the differential pressure sensor is below the high DP minimum but above the low DP limit the system continues its operation. As explained above, over time the actual DP begins to drop and when it falls below the low DP limit for an amount of time the controller causes the valve to close and the cycle begins again.

Because the values used to determine when to open and close the valve are dynamic and based upon the actual conditions in the system, production of gas is optimized even when the well's ability to produce natural gas or the sales line pressure varies. Furthermore, because the controller partially closes the valve to adjust the differential pressure in the sales line, excessive gas flow rates that cannot be measured by a sales meter positioned in the sales line are minimized.

In an alternative embodiment, the controller closes or opens the valve based on the flowrate of gas in the sales line, not the actual DP in the sales line. In this alternative embodiment, the controller maintains the actual flowrate between a maximum flowrate and a minimum flowrate by adjusting the valve in a manner similar to the preferred embodiment. The maximum flowrate and a minimum flowrate are each set to a percentage above and below a flowrate setpoint, respectfully. If the actual flowrate exceeds the maximum flowrate, the controller incrementally begins closing the valve until the actual flowrate approximately equals the flowrate setpoint. When the actual flowrate falls below the minimum flowrate the controller incrementally begins opening the valve until the actual flowrate is approximately the flowrate setpoint. Eventually, gas pressure developed by the well drops to the point where the gas pressure is insufficient to maintain the minimum flowrate, even if the valve is completely open. At this point, when the actual flowrate falls below the minimum flowrate for a fixed amount of time, the controller causes the valve to close and the cycle begins again.

Figure 1:
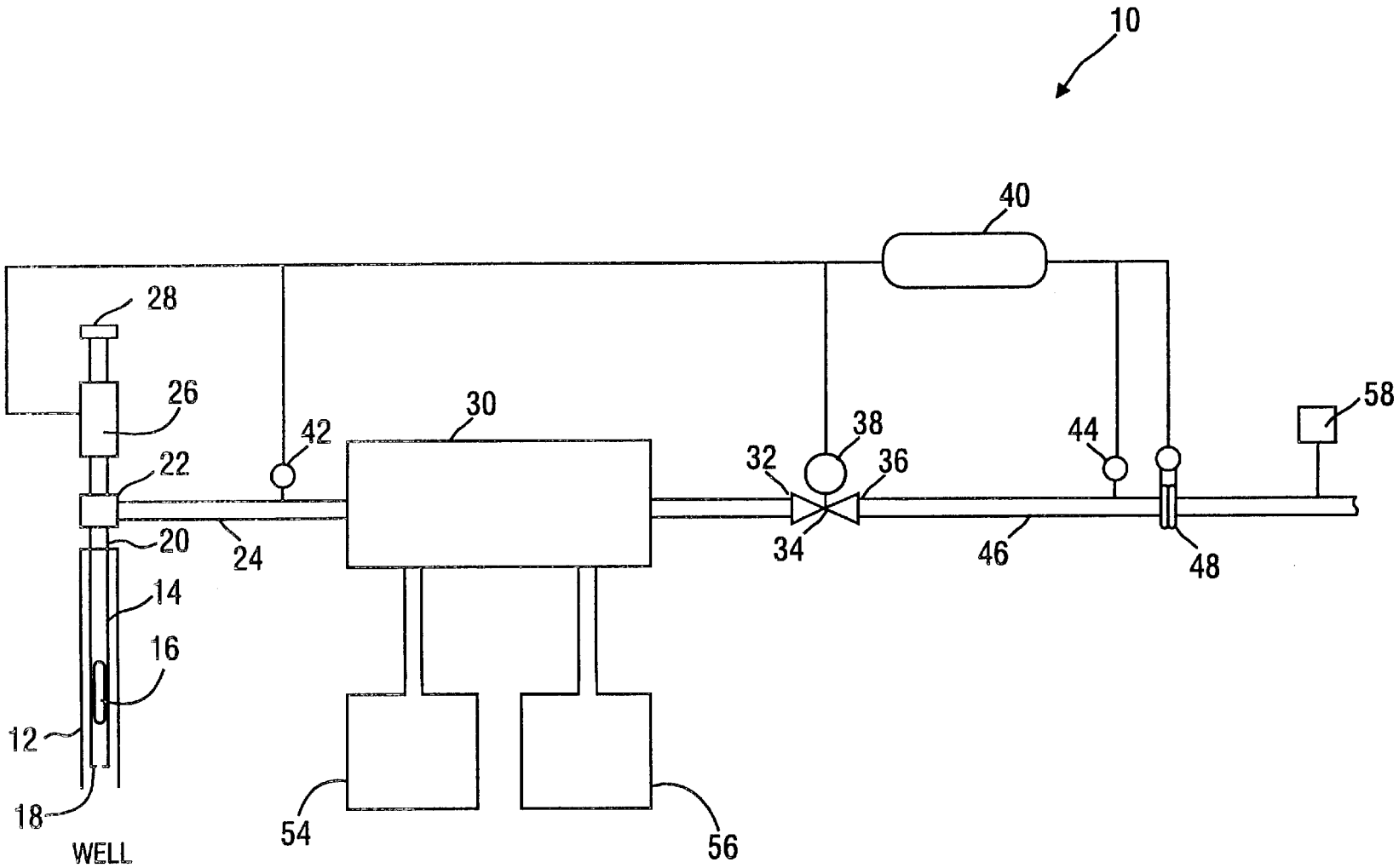
FIG. 1 is a block diagram of the apparatus for closed loop control of a well plunger system embodying the present invention.

While the invention is susceptible to various modifications and alternative forms, specific embodiments thereof are shown by way of example in the drawings and are described in detail. It should be understood, however, that the drawings and description are not intended to limit the invention to the particular forms disclosed. On the contrary, the intention is to cover all modifications, equivalents, and alternatives falling with in the spirit and scope of the invention as defined by the appended claims.

DETAILED DESCRIPTION OF THE INVENTION

Turning now to the drawings and referring to FIG. 1, a well plunger system 10 positioned in a casing 12 in a well and connected to a gas line distribution system is illustrated. The well casing 12 is hollow and is open at its bottom end to allow gas, oil and water (if present) to flow into the casing 12. Inside the casing 12 is a plunger tube 14. The plunger tube 14 contains a plunger 16 capable of moving lengthwise within the plunger tube 14. The plunger 16 is moveable by pressure and gravity. At the bottom of the plunger tube 14, plunger 16 movement is restricted by a stop 18.

The casing 12 is sealed to the plunger tube 14 at the top 20 of the casing 12. The plunger tube 14 passes through a junction box 22 where it is connected to a tubing line 24. Above the junction box 22 the plunger tube 14 passes through a plunger sensor 26 and ends just above the plunger sensor 26 at an upper stop 28. The upper stop 28 includes a coiled spring (not shown) positioned at the top and inside the plunger tube 14 to help stop the plunger. The plunger sensor 26 detects the presence or absence of the plunger 16 at the top of the plunger tube 14, above the casing 12, and produces a corresponding electrical signal. The plunger 16 is detected by the plunger sensor 26, or a corresponding jump in the tubing line pressure or differential pressure (flow rate increase) when the well is opened, as described below. In the preferred embodiment the plunger sensor 26 is a PS4 magnetic field sensor from EDI, Inc., available from Fluid Lift, Inc., P.O. Box 241, Hennessey, Okla. 73742.

From the junction box 22, the tubing line 24 passes through a production unit 30 and terminates at an inlet portion 32 of a valve 34 which also has an outlet portion 36. The production unit 30 is well known in the field and separates gas from oil and water. Opening and closing of the valve 34 is electromechanically controlled by a motor 38. While an electromechanical valve and motor are illustrated any type of valve and associated control can be used. The motor 38 is operated by a controller 40. In the preferred embodiment, the controller 40 is a V40 microprocessor from NEC, however any microprocessor which can receive the various inputs, perform the calculations and provide an output to control a valve as described herein can be used. The controller 40 receives electrical signals from a variety of sources including a tubing line pressure sensor 42 connected to the tubing line 24 and a sales pressure sensor 44 connected to a sales line 46. The electrical signals from sensors 42 and 44 are indicative of the pressure of gas at different points in the well plunger system 10. The controller 40 also receives electrical signals indicative of the differential pressure ("DP") of gas in the well plunger system 10 from a differential pressure sensor 48 also connected to the sales line 46. The DP refers to the differential pressure at one point in the sales line 46 which corresponds to the velocity of gas passing that point. This is not to be confused with the differential pressure between the pressure in the tubing line 24 and the sales line 46.

Figure 2:
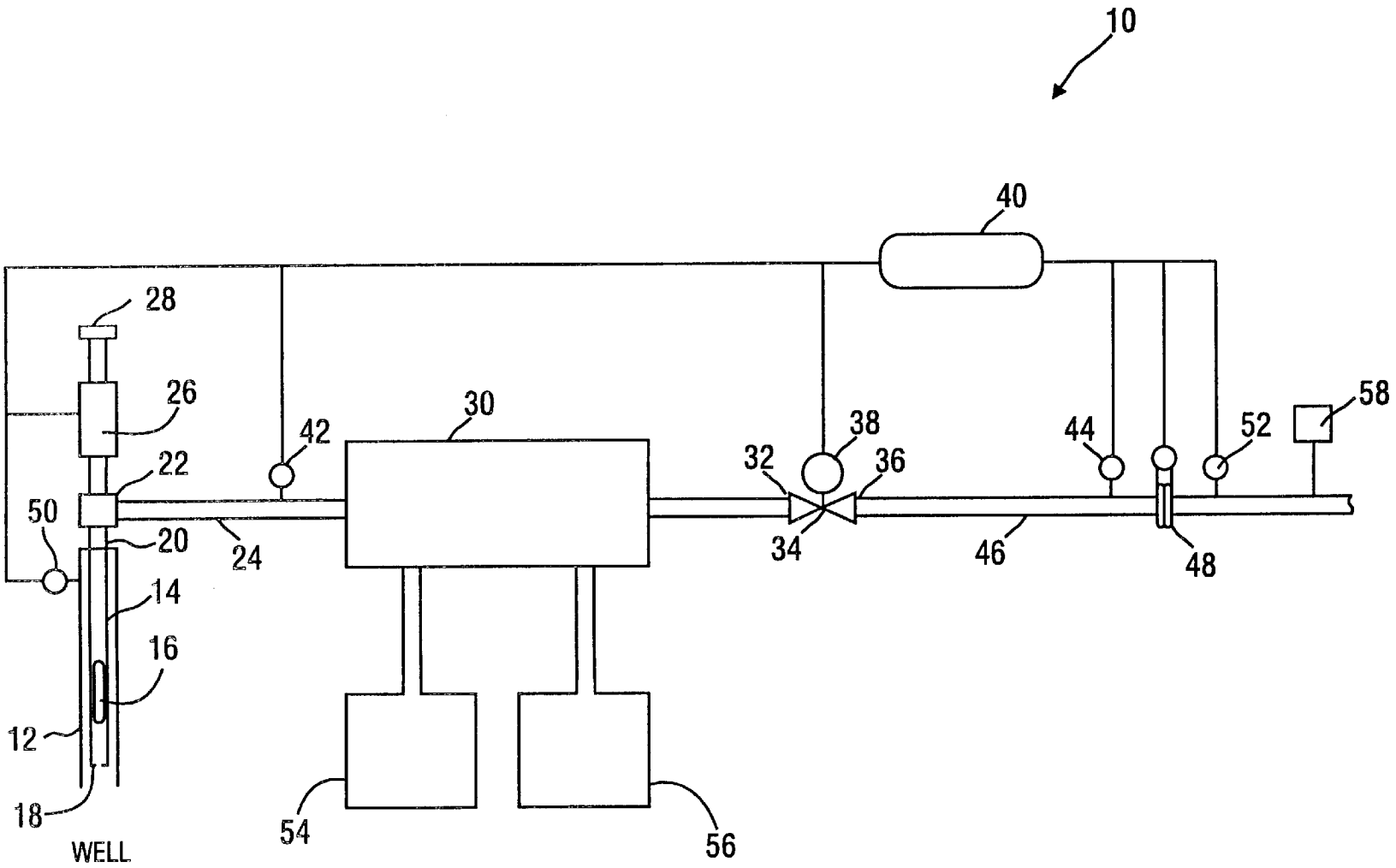
FIG. 2 is a block diagram of the apparatus for an alternative closed loop control of a well plunger system embodying the present invention.

As shown in an alternative embodiment illustrated in FIG. 2, the controller 40 also receives electrical signals indicative of the pressure of materials in the well plunger system 10 from a casing pressure sensor 50 connected to the casing 12 and electrical signals indicative of the temperature of gas in the well plunger system 10 from a sales temperature sensor 52 connected to the sales line 46. The sales temperature sensor 52 transmits electrical signals to the controller 40 indicating the temperature in the sales tubing 46. The signals from the temperature sensor 52 allow the controller 40 to calculate the flowrate of gas in the sales line in an alternative embodiment described below. As is known in the field, temperature is a factor controlling actual flowrate of gas in a pipe. The casing pressure sensor 50 transmits signals to the controller 40 indicating the pressure inside the casing 12. The controller 40 uses the signals from the casing pressure sensor 50 to determine actual flowrate in an alternative embodiment described below.

After a minimum amount of time has passed since the valve 34 was closed and the difference in pressure between tubing line 24 and the sales line 46 exceeds a threshold designated as the open pressure setpoint, the controller 40 causes the valve 34 to open. Waiting a minimum amount of time after the valve 34 is closed before reopening allows the plunger 16 to drop to the stop 18 at the bottom of the plunger tube 14. The minimum amount of time is calculated based on the type of plunger 16 used and the depth of the well as is well known to those of ordinary skill in this field. Just prior to the opening of the valve 34 the pressure in the tubing line 24 is significantly higher than the pressure in the sales line 46. Once the valve 34 is opened, gas in the tubing line 24 and plunger tubing 14 will rapidly expand through the valve 34 into the sales line 46. This causes the pressure above the plunger 16 to decrease. The plunger 16, which was resting on the bottom of the plunger tube 14 when the controller 40 opened the valve 34, begins to rise inside the plunger tube 14 because the pressure below the plunger 16 is greater thin the pressure above it. As the plunger 16 rises it remains relatively sealed against the walls of the plunger tube 14 such that the plunger 16 lifts the slug of water and oil above it, along with the gas, through the plunger tube 14. The slug and the gas are forced up through the junction box 22 into the tubing line 24 as is well known in the field. The plunger 16 moves through the junction box 22, allowing the remaining gas and perhaps some oil and water to continue flowing through the tubing line 24. The gas, oil and water flow through the tubing line 24 to the production unit 30 where the oil is separated and transferred to an oil tank 54 and the water is separated and transferred to a water tank 56 as is well known in the field. The gas passes through the production unit 30 to the valve 34 and into the sales line 46 where it is eventually delivered to customers. The amount of gas produced is measured and recorded by a sales meter 58 attached to the sales line 46.

The plunger sensor 26 detects the arrival of the plunger 16 at the upper stop 28 at the top of the plunger tubing 14. To prevent failure of the entire well plunger system 10 if the plunger sensor 26 fails, the controller 40 monitors tubing line pressure and DP pressure changes to monitor plunger 16 travel. Once the valve 34 is opened, the plunger 16 will rise inside the plunger tube 14 causing changes in tubing line pressure and DP. As the plunger 16 begins to rise, pressure in the tubing line 24 will decrease, however, as the plunger 16 begins to deliver the slug of fluids into the tubing line 24 the tubing line pressure and DP will sharply increase, signaling the arrival of the plunger 16 to the controller 40. If the plunger detector 26 does not report the arrival of the plunger 16, changes in tubing line pressure or DP still provide an indication that the plunger 16 has arrived.

The controller 40 determines when to close the valve 34 in the manner described in detail below. When the valve 34 is closed, the pressure above and below the plunger 16 becomes approximately the same, so the force of gravity becomes the dominant force on the plunger 16. Gravity pulls the plunger 16 back down inside the plunger tube 14 until the plunger 16 comes to rest on the bottom of the plunger tube 14. The plunger 16 is designed to let fluid pass through or around the plunger 16 as it descends the plunger tube 14 as is well known in the field.

Figure 3A:
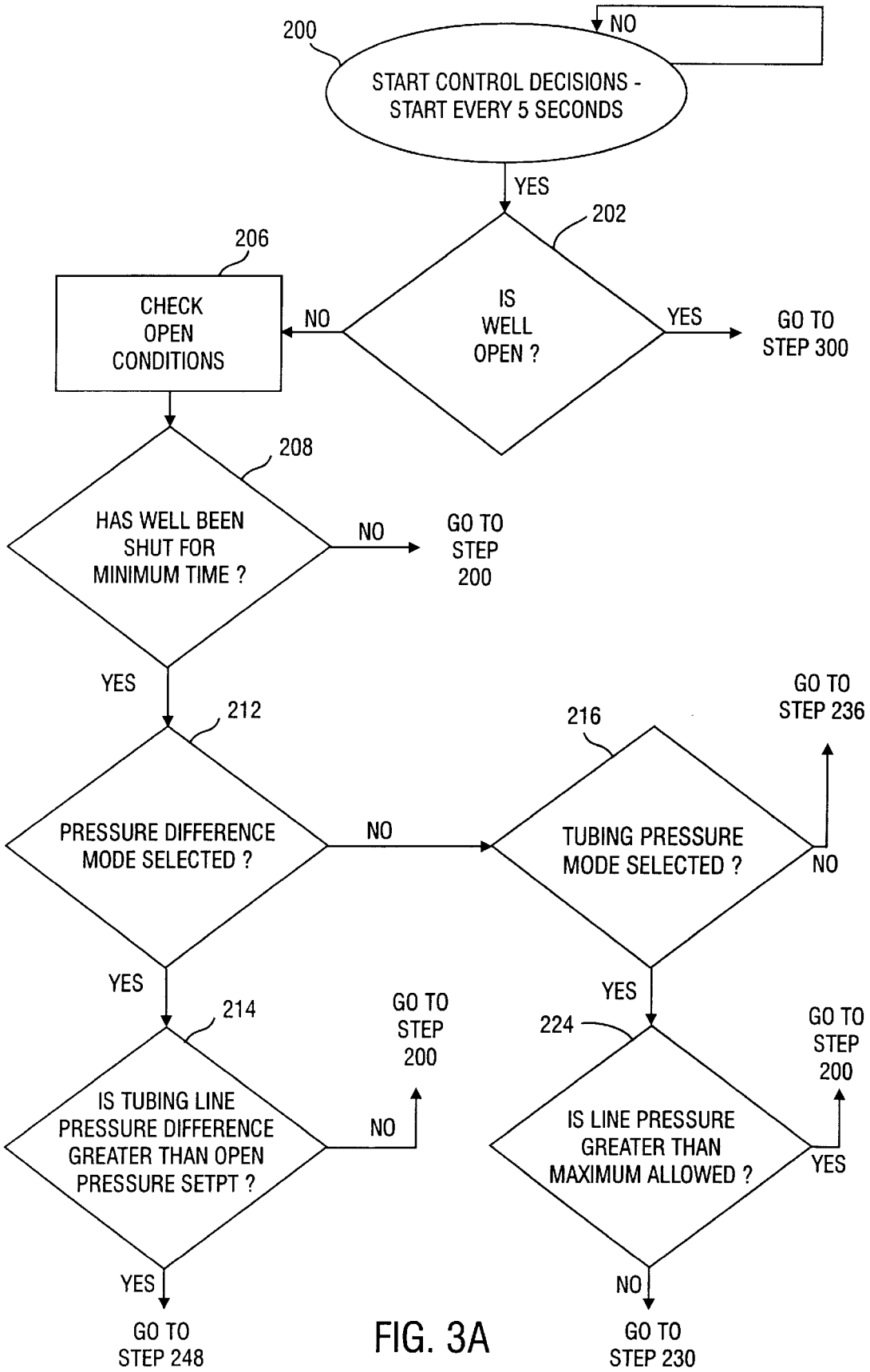
FIG. 3A is flow chart of a portion of the process for the closed loop control of a well plunger system showing the initial steps taken by a controller according to the present invention.

As illustrated in FIGS. 3A–3F, the controller 40 performs a series of steps to optimize production in the well by selecting and adjusting the times at which the valve 34 is opened and closed. In FIG. 3A, step 200, the controller 40 determines if a preselected amount of time has past since another step has been performed. In the preferred embodiment the preselected amount of time is 5 seconds, however the amount of time can be varied. If 5 seconds has not past, the controller 40 continues to wait until 5 seconds has past.

Once 5 seconds has past, step 202 determines if the valve 34 is open, if it is then the controller 40 proceeds to step 300, if not, the controller 40 proceeds to step 206, where various conditions in the well plunger system 10 are checked by the controller. In step 208, the controller 40 determines if the valve 34 controlling the well has been shut off for a minimum off period of time, which is the amount of time necessary for the plunger 16 to reliably descend as far as possible through the plunger tube 14, if so, proceed to step 212, if not, go to step 200. The minimum off period of time depends on the depth of the well and the type of plunger 16 employed. For example, if the well is 7,500 feet deep the minimum off time will be approximately 30 minutes. If the valve 34 has not been shut off for the minimum period of time set for this particular well, the controller 40 returns execution to step 200. Once the well has been off for at least the minimum amount of time, the controller 40 proceeds to one of three different modes selected prior to installation of the system 10 depending on the type of well and equipment in which the well plunger system 10 is being used. The three modes are: 1) differential pressure, 2) tubing line pressure, and 3) maximum tubing line pressure. The operator of the well selects one of the three modes for the well plunger system 10 based on the configuration of equipment as described below.

In step 212, if the pressure difference mode is selected the controller 40 proceeds to step 214, otherwise, go to step 216. In the pressure difference mode, the valve is opened when the pressure difference between the tubing line pressure and sales line pressure exceeds a preselected threshold, i.e., the open pressure setpoint. Because the open pressure setpoint is based on the pressure difference, if the sales line pressure increases, the controller 40 keeps the valve 34 closed until there is enough pressure to lift the plunger 16. This is important because if the plunger 16 does not rise completely then the well often fills with oil or water. Conversely, if the sales line pressure decreases, then the valve 34 is opened earlier. This too is important because opening the valve 34 as soon as possible optimizes the production of gas for that well. Thus, utilizing pressure difference enables the present invention to optimize production in wells with varying sales line pressure. Once the pressure difference between the tubing line pressure and sales line pressure exceeds the open pressure setpoint in step 214, proceed to step 248, otherwise go to step 200.

If the well plunger system 10 for this particular well is not using the pressure difference mode, then instead of going to step 214, the controller performs step 216. The operator of the well determines which mode is most appropriate for the well plunger system 10 based on the equipment and conditions at that particular well. The operator provides this information to the controller 40 to select the appropriate mode. At step 216 the controller 40 determines whether the tubing line pressure mode has been selected. The tubing line pressure mode is selected by the operator if the well plunger system 10 includes a separate compressor (not shown) to draw gas out of the well as is known in the field, if so, the controller 40 opens the valve 34 based on tubing line pressure, and the controller 40 proceeds to step 224, if not, then the controller 40 proceeds to step 236. The tubing line pressure mode is generally selected when a compressor is between the tubing line 24 and the sales line 46. In this mode, the valve 34 will open when the tubing line pressure exceeds the open pressure setpoint based on the difference between the tubing line pressure and the level of suction from the compressor, unless the sales line pressure exceeds a maximum pressure, in which case the valve 34 will not be opened. The maximum sales line pressure check keeps the valve 34 from opening against an overloaded sales line 46.

At step 224, if the sales line pressure is greater than the maximum allowed, go to step 200. However, if the sales line pressure is not greater than the maximum allowed, proceed to step 230 in FIG. 3B. At step 230 if the tubing line pressure is greater than the open pressure setpoint then proceed to step 248 in FIG. 3F, otherwise, return to step 200, FIG. 3A.

Figure 3B:
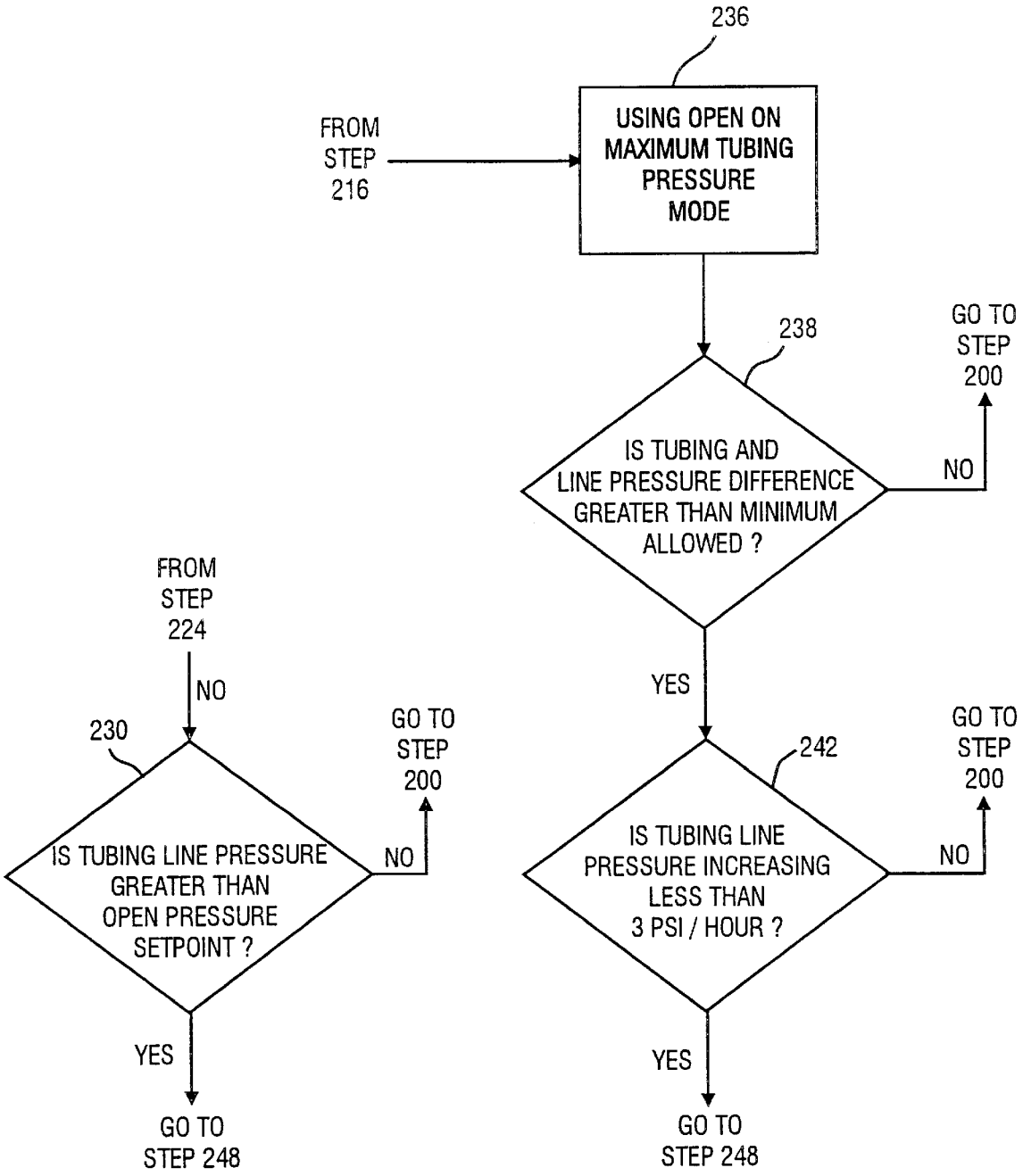
FIG. 3B is flow chart of a portion of the process for the closed loop control of a well plunger system showing some of the steps performed by the controller when a valve controlling the well is closed according to the present invention.

If the controller 40 had proceeded to step 216 above and the tubing line pressure mode was not selected, then the controller 40 proceeds to step 236 in FIG. 3B. In step 236, the controller 40 begins executing steps for the maximum tubing line pressure mode, which is selected by the operator when the well is very heavily loaded with fluids and not properly functioning. From step 236, proceed to step 238. The maximum tubing line pressure mode allows the well to build to a maximum pressure before opening. Although this mode is generally used on a well that is heavily loaded with fluids, it can also be used with a well that doesn't have a plunger. The difference between the tubing line pressure in the tubing line 24 and the sales line pressure in the sales line 46 must also exceed a minimum to keep the well from opening against a sales line 46 under high pressure, which could prevent the plunger 16 from arriving at the plunger sensor 26. The minimum is calculated based on the minimum amount of pressure difference needed to completely raise the plunger 16 in that well. In step 238, if the tubing line pressure difference is not greater than the minimum allowed, then proceed to step 200, if the tubing line pressure difference is greater than the minimum allowed, proceed to step 242. In step 242, if the tubing line pressure is increasing less than some minimum amount per hour then proceed to step 248 in FIG. 3F. In the preferred embodiment, the minimum amount of tubing line pressure increase per hour is 3 pounds per square inch ("psi"), although other values may be selected.

Figure 3C:
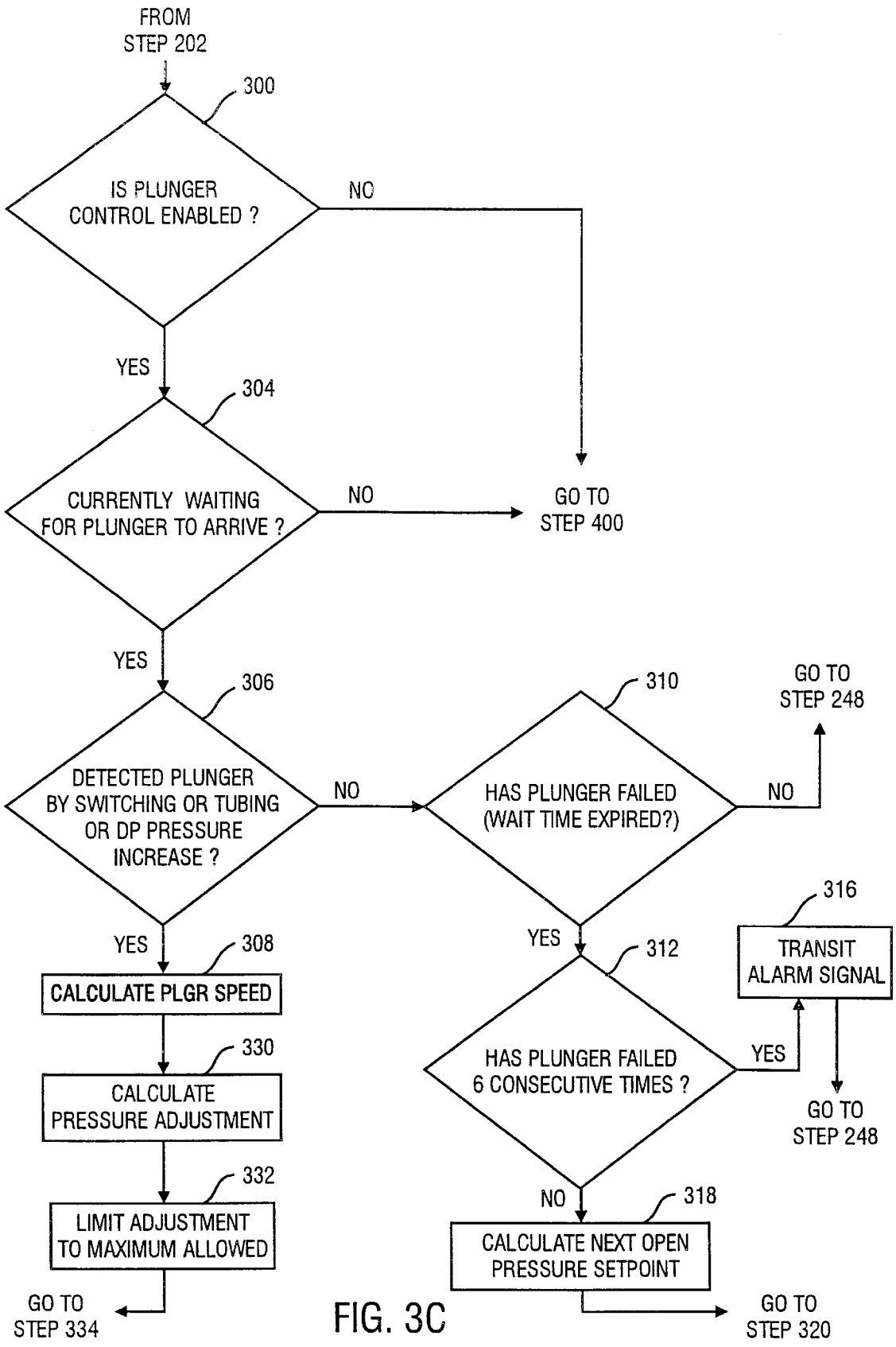
FIG. 3C is flow chart of a portion of the process for the closed loop control of a well plunger system showing some of the steps performed by the controller to control a plunger in the well according to the present invention.
Figure 3D:
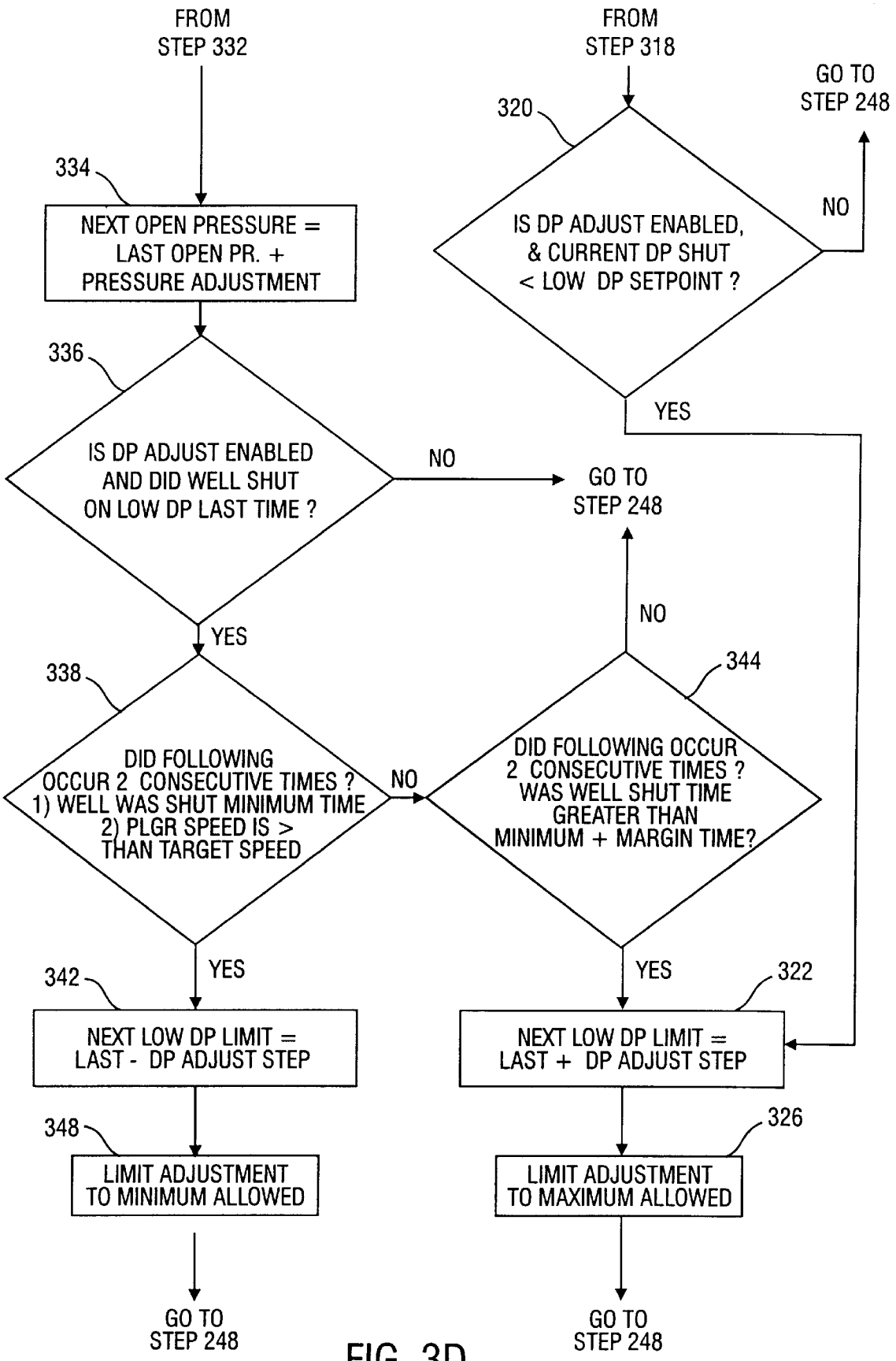
FIG. 3D is flow chart of a portion of the process for the closed loop control of a well plunger system showing some of the steps performed by the controller to adjust the thresholds used to open and close the valve controlling the well according to the present invention.
Figure 3E:
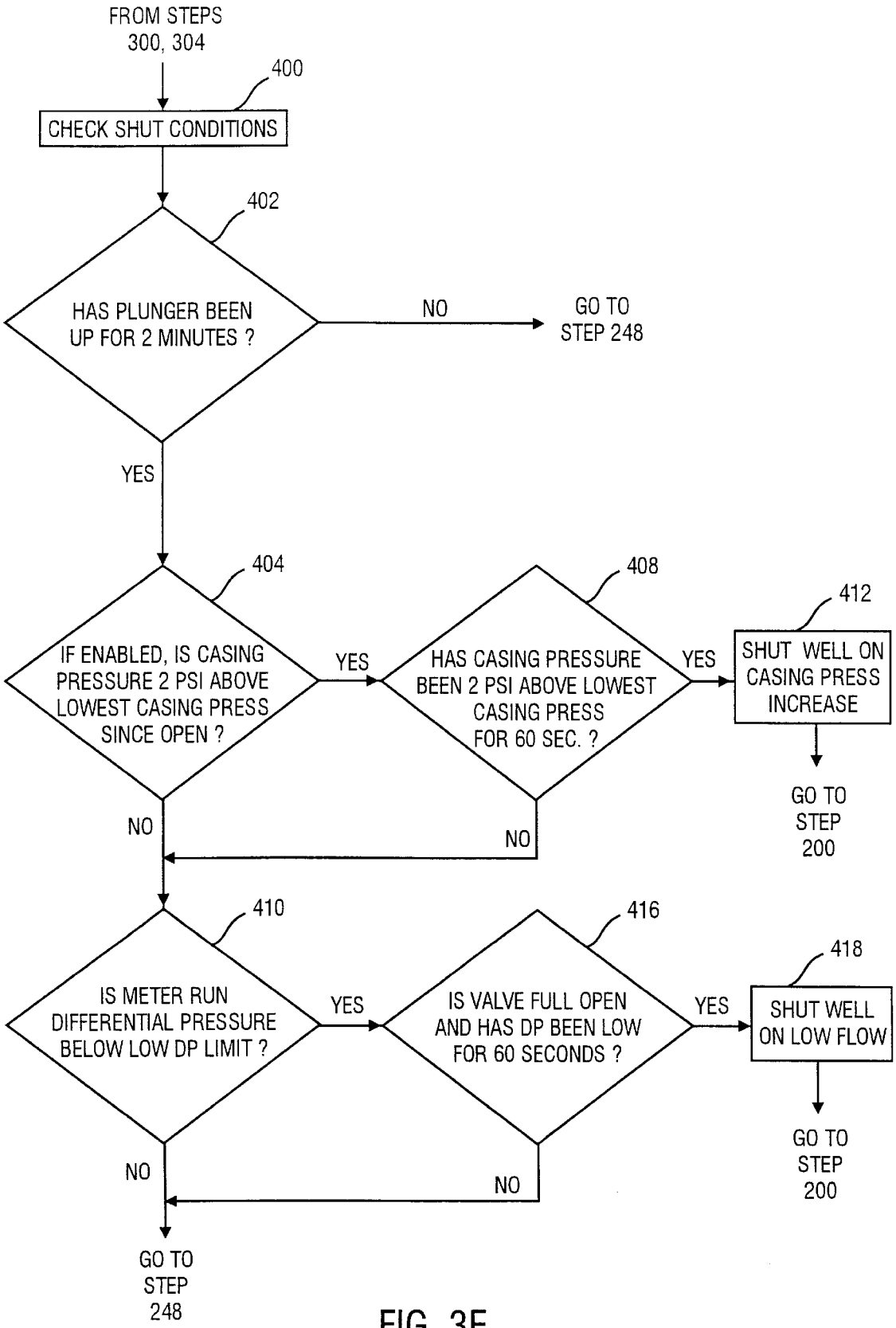
FIG. 3E is flow chart of a portion of the process for the closed loop control of a well plunger system showing some of the steps performed by the controller to close the valve controlling the well according to the present invention.
Figure 3F:
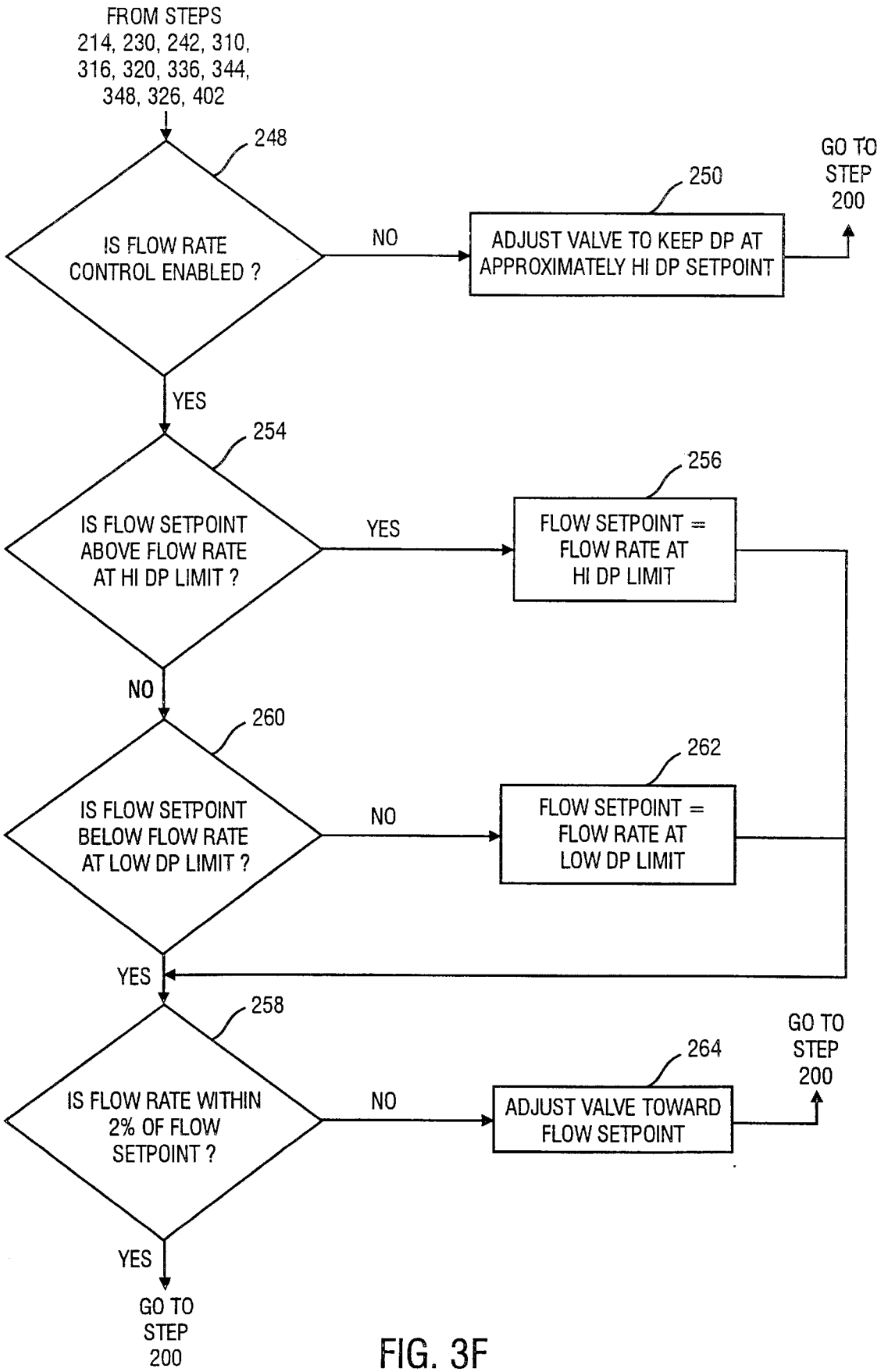
FIG. 3F is flow chart of a portion of the process for the closed loop control of a well plunger system showing some of the steps performed by the controller to maintain the production of gas when a valve controlling the well is open according to the present invention.

Turning to the open well control section in FIG. 3F, if the conditions in steps 214, 230, 242, 310, 316, 320, 326, 348 or 402, are satisfied, the controller 40 proceeds to step 248. In the preferred embodiment, at step 248, flowrate control is not enabled and step 250 is performed. At step 250, the controller 40 adjusts the amount the valve 34 is opened to maintain the actual DP at the high DP setpoint between the slightly higher high DP limit and the slightly lower high DP minimum. For example, in the preferred embodiment where the sales meter 58 has a maximum DP rating of 100 inches (water column pressure), the high DP setpoint is set to 93 inches, the high DP limit is set to 95 inches and the high DP minimum is set to 91 inches. When the DP sensor 48 indicates to the controller 40 that the actual DP has risen above the high DP limit or below the high DP minimum, the controller will adjust the valve 34 by a DP adjustment step to keep the actual DP approximately at the DP setpoint, between the high DP limit and the high DP minimum, then the controller 40 proceeds to step 200. This means that the maximum amount of gas the well can produce is flowing through the sales line 46 without exceeding the maximum differential pressure limitation of the sales meter 58. The present invention eliminates the "free gas problem", i.e. delivering gas to the sales line 46 beyond the capability of the sales meter to record it, because the capability of the sales meter is never exceeded. This can result in significant savings to the gas producer. Using DP is preferred because it is the most accurate way to describe the maximum recordable amount of gas by commonly used sales meters.

In an alternative embodiment, flowrate control can be selected at step 248 if the user prefers to control the flowrate of the well, then the controller 40 proceeds to step 254. Note that flowrate is calculable from DP and sales line pressure and gas temperature in the sales line 46. A flowrate setpoint is initially set by the operator at a desired flowrate which may be a best guess for maximum flowrate, then is adjusted by the controller 40 as described below. At step 254, if the flowrate setpoint is higher than the actual flowrate at the high DP limit, then proceed to step 256 and reset the flowrate setpoint to be equal to the actual flowrate that occurs at the high DP limit and continue to step 258. If the flowrate setpoint is not above the high DP limit, proceed to step 260. At step 260, if the flowrate setpoint is less than the actual flowrate that occurs at the low DP limit, then proceed to step 264 and reset the flowrate setpoint to be equal to the actual flowrate that occurs at the low DP limit and continue to step 258. If the flowrate setpoint is not below the low DP limit, proceed to step 258. At step 258, the controller divides the actual flowrate by the flowrate setpoint to determine the error percentage. If the actual flowrate is within certain percentage of the flowrate setpoint, then proceed to step 264 and adjust the valve 34, otherwise proceed to step 200 in FIG. 3A. In the preferred embodiment the certain percentage is 2 percent of the flowrate setpoint. In step 264, the controller 40 uses the actual error percentage calculated in step 258 to adjust the valve 34 by correspondingly opening or closing the valve by an amount calculated to eliminate a small amount of the error percentage. As the controller repeatedly returns to step 258, the error percentage will be reduced to less than 2 percent. If the actual flowrate was within 2 percent of the flowrate setpoint then return to step 200.

Returning to step 202 in FIG. 3A, after the valve 34 opens, the controller 40 waits for the plunger 16 to arrive at the plunger sensor 26 to make adjustments to the low DP limit used to close the valve 34. The plunger 16 is detected by either the plunger detect switch 26, or by a corresponding junp in the tubing line pressure as detected by the a tubing line pressure sensor 42 or a corresponding jump in the actual DP as detected by the differential pressure sensor 48. Detection of the increase in tubing line pressure or in the DP acts as a backup in case the plunger sensor 26 fails.

When the plunger 16 arrives, the open pressure setpoint is adjusted proportionally to the difference between the plunger's 16 average speed and a target speed. If the average plunger speed is higher than the target speed, the open pressure setpoint is lowered, and if the speed is low, the open pressure setpoint is increased. In the preferred embodiment the target speed is 700 feet per minute.

If the plunger fails to arrive, the open pressure setpoint is increased by a certain percentage that is 3 percent in the preferred embodiment. If the plunger fails 6 consecutive times, the open pressure setpoint is no longer adjusted to prevent extreme setpoints.

The low DP limit is the threshold point below which any actual DP as measured by the DP sensor 48 causes the controller 40 to direct the motor 38 to shut off the valve 34. In some wells the gas production is such that the tubing line 24/sales line 46 pressure difference builds so fast that even opening the well after the minimum amount of time is not sufficient to prevent the plunger from reaching excessively high speeds, potentially causing damage to the plunger 16 and the well plunger system 10. Under these conditions, lowering the open pressure setpoint has no effect on reducing the pressure difference across the plunger 16 since the well must remain closed for the minimum shut time anyway during which even greater pressures build. To solve this problem, the low DP limit is lowered if: 1) the well has enough pressure to be opened immediately after the minimum shut time expired, 2) the speed of the plunger 16 is too high, and 3) the well has been shutting on the low DP limit. The speed of the plunger 16 is decreased by lowering the low DP limit which tends to increase the amount of water or oil loading on the well, slowing the plunger's 16 rise, and preventing plunger 16 damage due to high speeds. The low DP limit is adjusted upward if the amount of time the valve 34 is closed has increased more than a margin time, which in the preferred embodiment is 15 minutes, above the minimum shut time, which in the preferred embodiment is 30 minutes, and the low DP limit was previously adjusted down. If the plunger 16 fails to arrive, and the controller 40 has adjusted the low DP limit down, it will be stepped back up in pressure increments of 0.25 inches (water column pressure) to decrease loading.

Returning to FIG. 3A, if at step 202 the valve 34 is now open, proceed to FIG. 3C, step 300. At step 300, if plunger control is not enabled, proceed to step 400 in FIG. 3E to begin checking conditions for shutting the well by closing off the valve 34. However, if at step 300 plunger control is enabled, proceed to step 304. At step 304 if the controller 40 is waiting for the plunger 16 to arrive after the valve 34 has been opened, then go to step 306, otherwise, go to step 400 in FIG. 3E. In step 306, if the plunger 16 has been detected by the plunger sensor 26 or by other methods described above, proceed to step 308, otherwise, proceed to step 310.

In FIG. 3C at step 310, the controller 40 determines if the plunger 16 has failed to rise to the upper stop 28 of the plunger tube 14 after the wait time has expired. In the preferred embodiment, the wait time is twice the calculated rise time determined by any one of several formulae well known to those skilled in this field. If the plunger 16 has not been detected within the wait time, proceed to step 312, otherwise, proceed to step 248 in FIG. 3F. At step 312, if the plunger 16 has failed to rise a specified number of times, in the preferred embodiment this is 6 times, then proceed to step 316 and transmit an alarm signal to the operator, then proceed to step 248 in FIG. 3F, otherwise proceed to step 318 and calculate the next open pressure setpoint. The next open pressure setpoint is calculated by adding a pressure adjustment to the current open pressure setpoint. In the preferred embodiment, the pressure adjustment is equal to a gain factor, typically 10, multiplied by the quantity of the desired average plunger speed, typically 700 feet per minute, minus the actual average plunger speed, that quantity divided by 1200. The gain factor is determined empirically based on the particular characteristics of the well and equipment used.

Proceeding from step 318 to step 320 in FIG. 3D, determine if the controller 40 is enabled to adjust the current low DP limit and if so whether the current low DP limit is less than the original low DP limit. If the answer to both questions in step 320 is yes, proceed to step 322, otherwise, proceed to step 248 in FIG. 3F. At step 322, the current low DP limit is adjusted by an adjustment step of 0.25 inches (water column pressure). From step 322, proceed to step 326 where the controller 40 limits the low DP limit be no greater than the original DP limit, a typical low DP limit in the preferred embodiment is 10 inches (water column pressure). From step 326, proceed to step 248 in FIG. 3F.

Returning to step 306 in FIG. 3C, if the plunger 16 was detected as described above, proceed to step 308 where the average speed of the plunger is calculated from the known distance traveled by the plunger 16 from the stop 18 at the bottom of the plunger tube 14 to the upper stop 28 at the top of the plunger tube 14 divided by the known time difference between when the controller 40 opened the valve 34 and when the plunger 16 was detected. From step 308, proceed to step 330 where an adjustment to the open pressure setpoint is calculated based on the difference between the target plunger velocity and the actual plunger velocity, as described above. Next, in step 332 the controller limits each adjustment to the open pressure difference to be no more than 10 psi. From step 332, proceed to step 334 in FIG. 3D, where the open pressure difference is changed by the pressure adjustment. Next, in step 336, determine if the controller 40 is enabled to adjust the low DP limit and if so whether the valve 34 was last closed on the low DP limit, if so, go to step 338, otherwise, go to step 248 in FIG. 3F. At step 338, if the following two conditions are met two consecutive times, proceed to step 342, otherwise proceed to step 344: 1) if the amount of time the valve 34 was closed is equal to the minimum amount of time allowed, and 2) if the plunger speed as calculated in step 308 greater than the target speed. If the answer to either inquiry in step 338 is no, proceed to step 344 in FIG. 3D where the controller 40 determines if the amount of time the valve 34 was closed equal to the minimum amount of time plus the margin time as described. If the answer to both inquiries at step 338 was yes, than proceed to step 342 where the current low DP limit is decremented by the DP adjustment step. From step 342, proceed to step 348 where the current low DP limit is limited to be no less than the minimum allowed. In the preferred embodiment, the current low DP limit cannot be less than 4 inches less than the original low DP limit, and in no case less than 3 inches. Next, proceed to step 248 in FIG. 3F.

Returning to FIG. 3C, if the answer to either inquiry at step 300 or step 304 was no, then the controller 40 proceeds to step 400, in FIG. 3E, to begin checking conditions for shutting the well by closing the valve 34. At step 402, if the plunger 16 has been at the upper stop 28 for 2 minutes then proceed to step 404, otherwise, proceed to step 248 in FIG. 3F. The well plunger system 10 waits for the plunger 16 to be at the upper stop 28 for two minutes to allow oil and water raised by the plunger 16 to be redirected through the tubing line 24 and the production unit 30 to the oil tank 54 and the water tank 56 respectively, allowing gas flow in the well plunger system 10 to stabilize. At step 404, if casing pressure sensing is enabled in an alternative embodiment, determine if the casing pressure as measured by the casing pressure sensor 50 in FIG. 2 is two pounds per square inch ("psi") above the lowest recorded casing pressure since the valve 34 was last opened, if so, proceed to step 408, if not, proceed to step 410. Casing pressure is used because when the valve 34 is open, gas production will eventually cause the plunger tube 14 will begin to fill with fluids, which cause a corresponding rise in casing pressure. The increase in casing pressure is detected by the casing pressure sensor 50 which transmits a signal corresponding to the casing pressure to the controller 40. At step 408, if the casing pressure has been 2 psi above the lowest casing pressure recorded for at least 60 seconds then proceed to step 412, otherwise, proceed to step 410. At step 412 the controller 40 will direct the motor 38 to close the valve 34, then proceed to step 200, in FIG. 3A. In this scenario, when the casing pressure begins to increase this means that the well is beginning to load (fill) with oil and/or water. Returning to step 410, if the actual DP as measured by the DP sensor 48 is below the low DP limit, then proceed to step 416, otherwise, proceed to step 248, in FIG. 3F. At step 416 if the valve 34 is completely open and the actual DP has been low for 60 seconds then proceed to step 418, otherwise, proceed to step 248, in FIG. 3F. At step 418 the controller 40 will direct the motor 38 to close the valve 34 because the actual DP has dropped too low, indicating undesirable fluid loading is occurring. From step 418, the controller 40 will proceed to step 200 in FIG. 3A.

In FIG. 3F, step 248, if the flowrate control, as described in detail below, has been selected for this particular well, proceed to step 250, otherwise, proceed to step 254. Flowrate control is selected by the operator by selecting a non-zero flowrate setpoint. The operator selects flowrate control when the primary focus is on controlling flowrate as opposed to maximizing gas production. In step 250, the controller 40 directs the motor 38 to adjust the valve 34 to maintain the differential pressure ("DP") between the tubing line pressure and the sales line pressure at the high DP setpoint. In the preferred embodiment, if the sales meter 58 is rated for a maximum DP of 100 inches (water pressure) then the high DP setpoint is set to 93 inches (water column pressure) in order to provide an operating margin for the well plunger system 10. From step 250, return to step 200, in FIG. 3A. At this point, the cycle of opening and closing the valve 34 repeats.

What is claimed is:

1. A dynamically adjustable well plunger system coupling a well to a gas distribution system having a sales line, comprising:

a plunger tube positioned within the well;

a movable plunger positioned within said plunger tube;

a valve having an inlet side and an outlet side, said outlet side connected to the sales line;

a tubing line connected between said plunger tube and said inlet side of said valve;

a first pressure sensor connected to said tubing line, said first pressure sensor capable of sensing the pressure within said tubing line and generating a first pressure signal;

a second pressure sensor connected to the sales line, said second pressure sensor capable of sensing the pressure within the sales line and generating a second pressure signal; and a controller receiving said first pressure signal and said second pressure signal and opening the valve when the controller determines the difference between said first pressure signal and said second pressure signal exceeds a threshold value;

wherein the threshold value is capable of being automatically adjusted bv the controller in response to information associated with the plunger.

2. The well plunger system of claim 1 wherein the plunger tube has a top; further comprising a plunger sensor connected near the top of the plunger tube, the plunger sensor producing a third signal indicative of the presence of the plunger near the top of the plunger tube, said controller receiving said third signal and adjusting said threshold value based thereon.

3. The well plunger system of claim 2, wherein said controller calculates an actual plunger arrival time based on how long it took for the plunger to reach the top of the plunger tube after the valve was opened and compares the actual plunger arrival times to an expected plunger arrival time and wherein the controller adjusts the threshold value by an amount proportional to the difference between the expected arrival time and the actual arrival time.

4. The well plunger system of claim 2, wherein said controller adjusts said threshold value by an amount proportional to an amount of time elapsed between said valve being opened and said controller receiving said third signal.

5. The well plunger system of claim 1, further comprising:

a differential pressure sensor connected to the sales line, said differential pressure sensor capable of sensing the differential pressure within said sales line and generating a differential pressure signal;

said controller receiving said differential pressure signal and partially closing said valve when said differential pressure signal rises above a predetermined high differential pressure limit.

6. The well plunger system of claim 5 including a sales meter connected to the sales line, wherein said high differential pressure limit is approximately the same as the maximum differential pressure limit of the sales meter.

7. The well plunger system of claim 5, wherein said controller closes said valve when said differential pressure signal falls below a low differential pressure limit.

8. The well plunger system of claim 7, wherein said controller decreases said low differential pressure limit if an average speed of said plunger is greater than a predetermined speed threshold and said valve is opened after a predetermined minimum shut time.

9. The well plunger system of claim 1 wherein the controller calculates an actual plunger speed and compares the actual plunger speed to a target plunger speed and wherein the controller adjusts the threshold value by an amount proportional to the difference between the actual plunger speed and the target plunger speed.

10. The well plunger system of claim 1 wherein the controller calculates an actual plunger speed and compares the actual plunger speed to a target plunger speed and wherein the controller lowers the threshold value if the actual plunger speed is greater than the target plunger speed and wherein the controller increases the threshold value if the actual plunger speed is less than the target plunger speed.

11. The well plunger system of claim 7, wherein said controller decreases said low differential pressure limit if an average speed of said plunger is greater than a predetermined speed threshold.

12. A method of controlling a well plunger system, coupling a well to a gas distribution system, said well plunger system comprising a plunger tube positioned within a well, the plunger tube having a top portion, a movable plunger positioned within said plunger tube, a tubing line connected to said plunger tube, a valve having an inlet side and an outlet side, said tubing line coupled to the inlet side of a valve, said outlet side of said valve connected to a sales line, a first pressure sensor connected to said tubing line, said first pressure sensor capable of sensing the pressure within said tubing line and, a second pressure sensor connected to said sales line, said second pressure sensor capable of sensing the pressure within said sales line, and a controller capable of operating said valve, comprising the steps of:

generating a first pressure signal with the first pressure sensor;

generating a second pressure signal with the second pressure sensor;

determining the difference between said first pressure signal and said second pressure signal; and opening said valve with the controller when said difference exceeds an open pressure thresholds; and automatically adjusting the open pressure threshold in response to information associated with the plunger.

13. The method of controlling a well plunger system of claim 12, further comprising the steps of:

sensing when said plunger reaches the top portion of the plunger tube;

determining an average speed of the plunger;

comparing the average speed of the plunger to a target plunger speed to produce a difference;

adjusting said open pressure threshold by an amount proportional to the difference between the average speed of said plunger and the target speed of said plunger.

14. Apparatus for controlling a well plunger system, said well plunger system including a plunger tube positioned within a well, a movable plunger positioned within said plunger tube, a tubing line connected to said plunger tube, said tubing line coupled to an inlet side of a valve, said valve having an outlet side connected to a sales line, said sales line connected to a gas distribution system, a first pressure sensor connected to said tubing line, said first pressure sensor capable of sensing the pressure within said tubing line and generating a first pressure signal, a second pressure sensor connected to said sales line, said second pressure sensor capable of sensing the pressure within said sales line and generating a second pressure signal, and a controller capable of operating said valve, comprising:

a controller, said controller receiving said first pressure signal and said second pressure signal and opening the valve when the controller determines the difference between said first pressure signal and said second pressure signal exceeds a threshold value, wherein the threshold value is capable of being automatically adjusted by the controller in response to information associated with the plunger.

15. The apparatus for controlling the well plunger system of claim 14 wherein said controller adjusts said threshold value by an amount proportional to the difference between a measured average speed of the plunger and a specified average speed of said plunger.

* * * * *